United States Patent [19]

Wolens et al.

[11] Patent Number: 4,959,911

[45] Date of Patent: Oct. 2, 1990

[54] APPARATUS FOR DRYING GARMENTS

[76] Inventors: John Wolens, 40 Hazel Ave., Glencoe, Ill. 60022; Nancy McGee, 44 Lawton Rd., Riverside, Ill. 60546

[21] Appl. No.: 434,763

[22] Filed: Nov. 13, 1989

Related U.S. Application Data

[63] Continuation of Ser. No. 225,283, Jul. 28, 1988, abandoned, which is a continuation of Ser. No. 88,099, Aug. 21, 1987, abandoned, and a continuation-in-part of Ser. No. 48,238, May 11, 1987, Pat. No. 4,777,737.

[51] Int. Cl.[5] ..... F26B 25/18

[52] U.S. Cl. ..... 34/237; 34/239; 34/151; 211/195

[58] Field of Search ..... 34/151, 238, 237, 233, 34/243 R; 211/195, 202

[56] References Cited

U.S. PATENT DOCUMENTS 3,572,260 1/1969 Lehrman ..... 211/195 X 3,577,650 5/1971 Brahm ..... 34/151

*Primary Examiner*—Albert J. Makay

*Assistant Examiner*—John Sollecito

*Attorney, Agent, or Firm*—Niro, Scavone, Haller & Niro, Ltd.

[57] ABSTRACT

A novel portable garment drying device for quickly drying garments is comprised of an air circulating means assembled with a support frame, an air permeable sheet upon which a garment is placed for drying, and bottom covering. The device is easily assembled and disassembled for storage or transport.

3 Claims, 1 Drawing Sheet

APPARATUS FOR DRYING GARMENTS

This application is a continuation of copending U.S. application Ser. No. 07/225,283 filed July 28, 1988, now abandoned, which was a continuation of copending U.S. application Ser. No. 07/088,099, filed Aug. 21, 1987, now abandoned, which was a continuation-in-part of copending U.S. patent application Ser. No. 07/048,238 filed May 11, 1987, now U.S. Pat. No. 4,777,737.

BACKGROUND OF THE INVENTION

This invention relates to a light, portable device for drying garments, such as wool or cotton sweaters, gloves, scarfs, and other delicate apparel.

The current state of the art in drying individual garments, such as sweaters, is remarkably limited. One can place such garments in a dryer on a stationary shelf or in a tumbling mode to dry the garment. Obviously dryers are not portable, and frequently the temperature control mechanism is such that the temperature in the dryer cannot be maintained at a low enough temperature to prevent shrinking.

Other alternatives to drying such garments are equally unsatisfactory. Placing a sweater on a hanger and letting it drip dry requires a substantial amount of time and can result in the undesired distortion of the garment's original shape. Placing a wet garment on a towel on a flat surface is a very slow process. Commercial devices that are currently marketed also are too slow. For example, there are available so-called sweater dryers that include a screen stretched on a frame so that a garment placed on the screen has both its front and back exposed to the air for drying. One must depend, however, on ambient air current and simple vaporation to accomplish the drying.

SUMMARY OF THE INVENTION

The purpose of this invention is to provide a portable device that can be moved easily throughout a household or disassembled and carried on trips. The invention provides a flow of air at ambient or slightly elevated temperature to dry garments without shrinking. The shape of the garment is also preserved. This invention provides, at low cost, an apparatus that substantially decreases the drying time of a wet garment.

The garment dryer of the present invention embodies, in combination, a support frame covered by a net or other air permeable sheet material; a water impermeable, and preferably, gas impermeable, bottom covering sheet; and a fan or other air circulating means mounted in said bottom covering sheet. The wet garment is placed on the net, and air is circulated from the surrounding environment into the bottom covering and up through the net and garment to accelerate drying.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings in which:

DESCRIPTION OF THE PREFERRED EMBODIMENT

Figure 1:
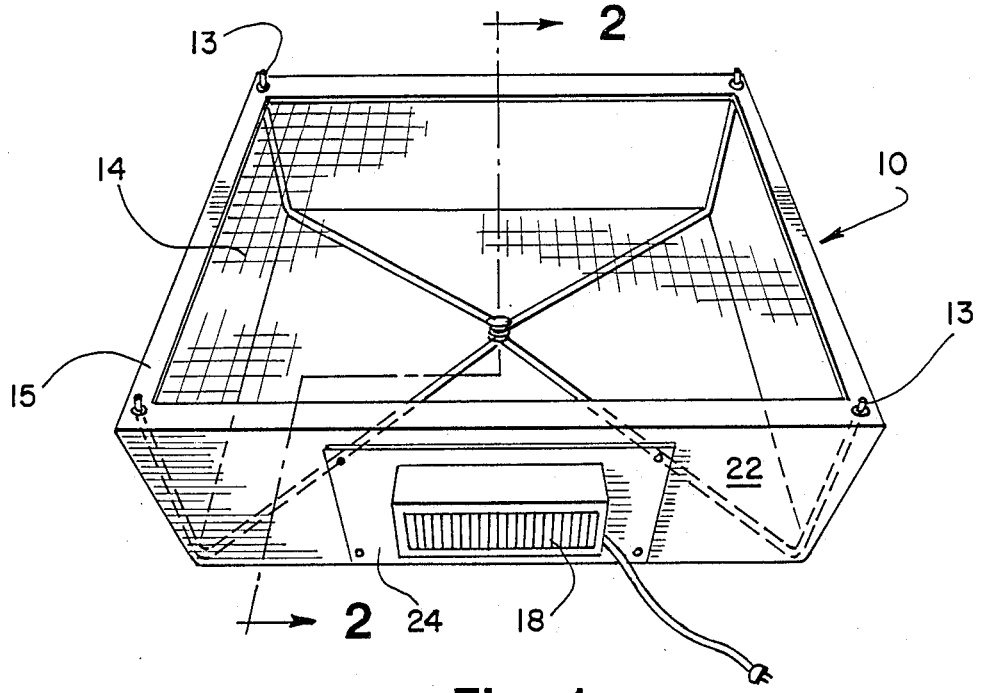
FIG. 1 is a perspective view showing one embodiment of the present invention.
Figure 2:
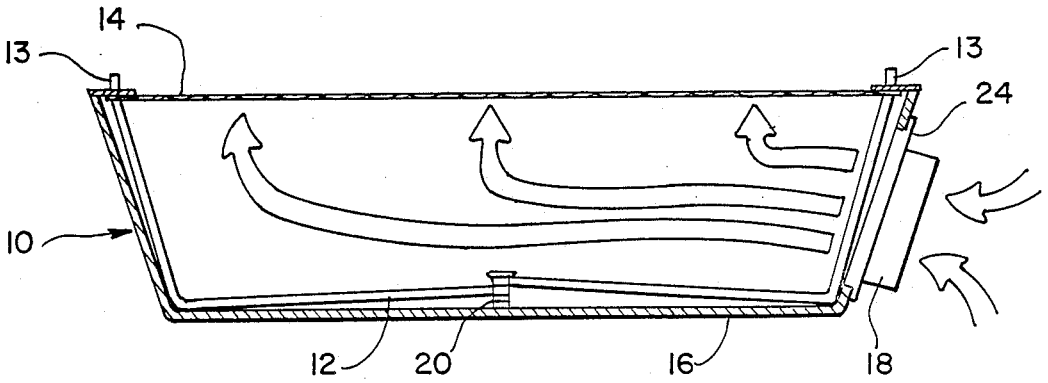
FIG. 2 is a sectional view taken along line 2—2 of FIG. 1.

A portable garment dryer 10 is shown in FIGS. 1 and 2 and includes a support frame 12, comprised of several segments, a net or air permeable sheet 14, a water impermeable bottom covering 16, and an air circulating means 18.

The frame 12 includes segments joined at a pivotal center point 20, with each segment terminating in an upwardly extending free end 13. The net 14 has a border 15 with means for joining the net to the frame. As shown in FIG. 1, the net may include grommets, located at each corner for assembly to the free ends 13 of the frame. The bottom covering 16 may be constructed either separately from or integrally with the net 14. Preferably, the bottom covering is constructed from vinyl sheet or other fluid impermeable material. If constructed separate from the net 14, the bottom covering should include means for assembly to the frame 12.

The bottom covering 16 includes one sidewall 22 having a aperature sized to accommodate air circulating means 18. Preferably, the air circulating means is a conventional 110 volt powered fan which is mounted to support 24. In turn, support 24 includes means such as snaps or velcro for attachment to side wall 22.

In operation, a garment is placed on the net 14 and power is supplied to fan 18. As a result, air is circulated from the ambient environment up and through the net and garment, thereby accelerating garment drying. Also, the bottom covering 16 catches any free water that drips from the garment to prevent damage to the surface on which the garment dryer is supported.

Because of the unique construction of the components of the present invention, it may be conveniently disassembled and folded for easy transport or storage. It is therefore truly portable.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. A portable and easily assembled and disassembled apparatus for drying a garment comprising:

a collapsible wire frame;

an air permeable and foldable net removably connected to said frame, said net having means being adapted to support said garment above said frame in a generally horizontal orientation;

a water impermeable bottom covering removably assembled to said frame, said bottom covering being constructed from a foldable sheet material; said bottom covering including a bottom and four sidewalls; and an air circulating means removably mounted directly to one of said sidewalls of said bottom covering for conveying air at about ambient temperature from the surrounding environment into said bottom covering and up and through said net and garment.

2. The garment drying apparatus of claim 3 wherein said net and said bottom covering are integrally constructed to form one foldable assembly.

3. The garment drying apparatus of claim 4 wherein said air circulating means includes a housing and said one sidewall of said bottom covering includes an attachment member adapted to removably join said housing directly to said one sidewall.

* * * * *